United States Patent [19]

Thompson

[11] Patent Number: 4,570,513

[45] Date of Patent: Feb. 18, 1986

[54] WRENCH WITH NUT-RETAINING MECHANISM

[76] Inventor: Martin L. Thompson, 422 North Western, Santa Maria, Calif. 93454

[21] Appl. No.: 576,255

[22] Filed: Feb. 1, 1984

[51] Int. Cl.[4] ..... B25B 13/02

[52] U.S. Cl. ..... 81/125

[58] Field of Search ..... 81/125, 90 B, 90 C, 81/321-323, 332-333, 393, 119

[56] References Cited

U.S. PATENT DOCUMENTS

| | | | |
|---|---|---|---|
| 1,146,544 | 7/1915 | Anderson | 81/125 |
| 1,251,347 | 12/1917 | Davis | 81/125 X |
| 1,390,408 | 9/1921 | Webber | 81/125 |
| 1,558,267 | 10/1925 | Mcbuckin | 81/125 |
| 1,585,338 | 5/1926 | Fisher et al. | 81/125 |
| 2,659,258 | 11/1953 | Dillard | 81/125 |
| 2,798,394 | 7/1957 | Hubbard | 81/125 |
| 3,376,765 | 4/1968 | Ruby | 81/125 X |
| 3,379,231 | 4/1968 | Gallo, Sr. | 81/125 X |
| 3,668,952 | 6/1972 | Teutsch | 81/125 |
| 4,063,472 | 12/1977 | MacIntyre et al. | 81/125 X |

FOREIGN PATENT DOCUMENTS

| | | | |
|---|---|---|---|
| 228721 | 12/1943 | Switzerland | 81/125 |
| 271609 | 2/1951 | Switzerland | 81/332 |

*Primary Examiner*—Frederick R. Schmidt
*Assistant Examiner*—Debra S. Meislin
*Attorney, Agent, or Firm*—Harvey B. Jacobson

[57] ABSTRACT

A box wrench has a mechanism for releasably locking a nut or bolt in the receiving cavity of the wrench, the mechanism comprising a detent which may be projected into the cavity or withdrawn from the cavity, an actuating lever for the detent on the outside of the wrench, and a thumb-operated keeper conveniently located on the wrench handle for controlling the position of the lever so that the detent can be projected and withdrawn without a user having to release the handle.

4 Claims, 4 Drawing Figures

WRENCH WITH NUT-RETAINING MECHANISM

BACKGROUND OF THE INVENTION

It is a convenience for a wrench to have a mechanism enabling the wrench to releasably lock onto a nut or bolt. For example, where a nut is to be threaded onto a bolt in an awkward or inaccessible position, the job is greatly simplified if the nut can be held in a wrench without being free to fall out, at least while placing the nut on the bolt and during the initial stage of threading. The present invention provides a wrench having this facility and which also has a simple-to-operate locking and release mechanism.

DESCRIPTION OF THE PRIOR ART

The following U.S. patents disclose wrenches and the like having retaining mechanisms, but none of these is believed to offer the convenience of the present invention:

| | | |
|---|---|---|
| 1,558,267 | J. J. McGuckin | Oct. 20, 1925 |
| 1,585,338 | W. T. Fisher | May 18, 1926 |
| 2,659,258 | J. Dillard | Nov. 17, 1953 |
| 2,798,394 | W. E. Hubbard | July 9, 1957 |
| 3,376,765 | V. L. Ruby | Apr. 9, 1968 |
| 3,668,952 | J. H. Teutsch | June 13, 1972 |
| 4,063,472 | R. W. MacIntyre et al | Dec. 20, 1977 |

SUMMARY OF THE INVENTION

A wrench in accordance with the present invention includes a detent which is movable between a locking position wherein the detent projects into the nut or bolt receiving cavity of the wrench, and a release position wherein the detent is withdrawn into the head of the wrench, the wrench further including actuating means for moving the detent between said positions, the actuating means extending from the head of the wrench to a location (e.g. on the wrench handle) where it can be readily manipulated by a user of the wrench.

In the case of a box wrench, for example, the detent may be located in an opening formed through the head of the wrench and may be connected to a lever pivotally mounted on the exterior of the wrench for moving the detent between the aforesaid positions responsive to pivotal movements of the lever. The lever may extend down from the head of the wrench along the handle to a position where it may be readily operated by a user without having to release the handle. In one preferred arrangement, a spring may be interposed between the wrench handle and the operative end of the lever urging the lever outwardly, and a thumb-operated keeper, which may be in the form of a pivotal yoke, may be provided to control movements of the lever and thereby of the detent. When fitting the wrench onto a bolt or nut, the detent is withdrawn, and when the bolt or nut is positioned, the lever may be used to move the detent into locking position against one side of the bolt or nut, thereby holding the bolt or nut in the wrench cavity. To retain the bolt or nut, the lever may be depressed and held by the keeper. To then release the bolt or nut, the lever may be released by the keeper, withdrawing the detent from the bolt or nut receiving cavity.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
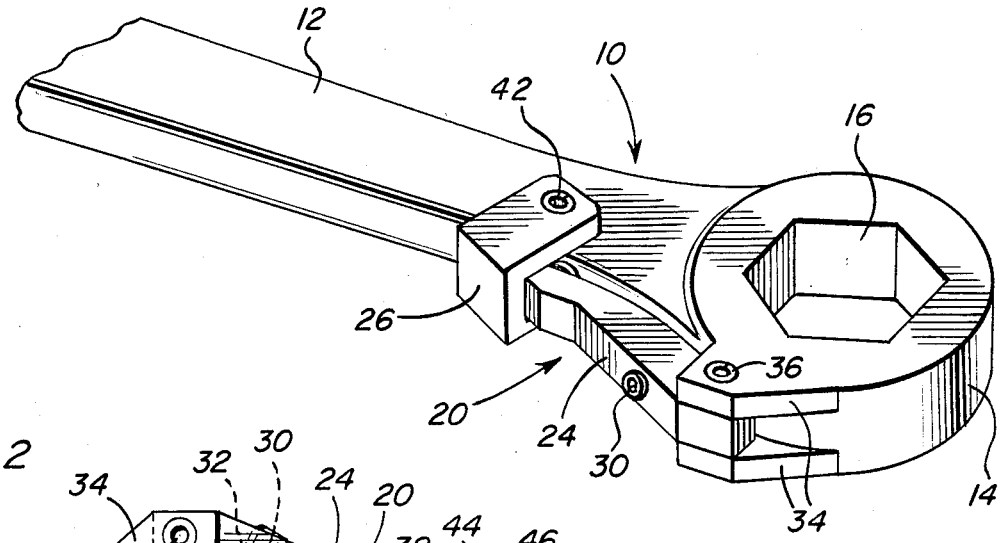
FIG. 1 is a perspective view of a box wrench (with the end of the handle broken away) having a nut-retaining mechanism in accordance with the invention.

Referring to the drawings, a box wrench 10 has a handle 12, a head 14, and a nut or bolt receiving cavity 16 of conventional form, it being understood that the wrench can be manufactured in the usual range of sizes to suit particular size bolts or nuts. In accordance with the invention, the wrench is provided with a nut-retaining mechanism, generally indicated at 20, enabling a nut 18, for example, to be releasably retained in cavity 16 without falling out.

The nut-retaining mechanism comprises, at least in the illustrated embodiment, a detent 22, a detent actuating lever 24, and a pivotal yoke-like keeper 26 for the lever. Detent 22 fits in an opening 28 formed through the wall of head 14 of the wrench. The outer end 30 of the detent is enlarged and threaded, and is generally in the form of an Allen screw which is received in a threaded bore 32 in the lever to enable adjustment of the detent 22 in the event of wear. Head 14 is provided with a pair of projecting ears 34 between which one end of lever 24 is pivotally mounted by means of a pivot pin 36. The lever extends down the head 14 of the wrench and along the side of the handle 12 at the upper end thereof. A coil spring 38 is received in a cavity in the side of handle 12 and urges lever 24 outwardly. Keeper 26 is pivoted to handle 12 by a pivot pin 42 and cooperates with ramp surfaces 44 and 46 at the end of lever 24.

Figure 2:
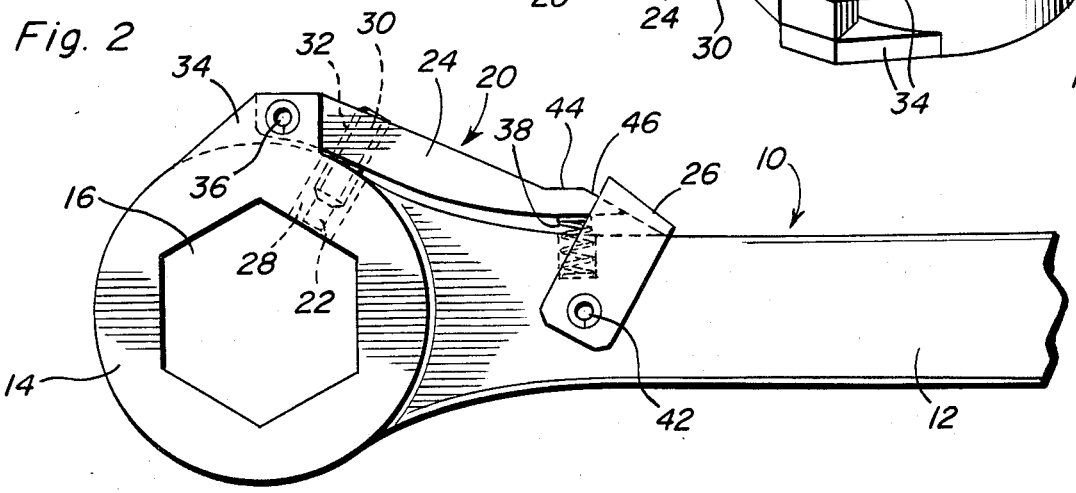
FIG. 2 is a plan view of the wrench showing the mechanism in the release position.
Figure 3:
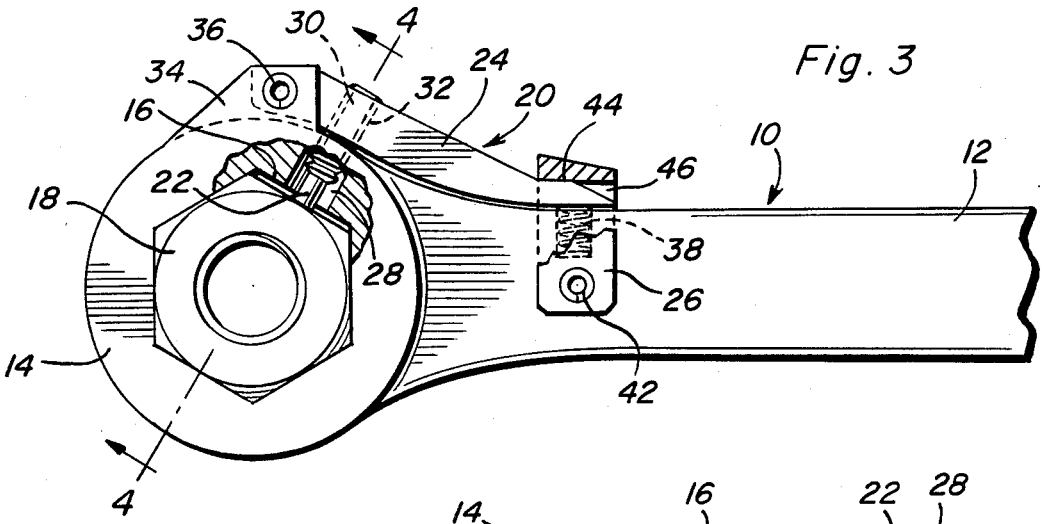
FIG. 3 is a plan view of the wrench, partly broken away and showing the mechanism in the nut-retaining position.
Figure 4:
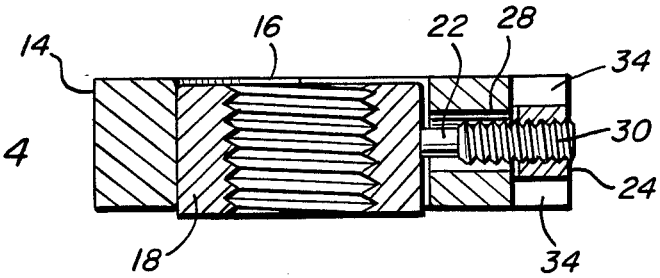
FIG. 4 is a sectional view on line 4—4 of FIG. 3.

When it is desired to insert a nut into cavity 16, keeper 26 is placed into the FIG. 2 position engaging ramp surface 46, thereby allowing spring 38 to press lever 24 outwardly and position detent 22 in the withdrawn position in opening 28. When it is desired to lock the wrench onto the nut, keeper 26 may be flicked over by thumb pressure into the FIG. 3 position where the keeper engages ramp surface 44, thereby camming lever 26 down against the action of spring 38 and causing the head of detent 22 to enter the nut-receiving cavity, press against one side of the nut, and thereby retain the nut in the wrench. Due to the angle of surface 44 and the cooperative inner keeper surface, the mechanism will remain in this position so that the nut can be manipulated without dropping from the wrench. When it is required to release the nut, keeper 26 may again simply be flicked over by thumb or finger pressure into the FIG. 2 position.

It will be appreciated that the positioning of keeper 26 and the design of the nut-retaining mechanism is such that it can be simply operated by a user of the wrench without having to release the wrench handle. The mechanism can be manufactured with minimal alteration to existing castings, and while the mechanism has been described herein in relation to a specific form of box wrench, the invention may be applied to both ends of such a wrench and incorporated into other styles of wrench.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wrench comprising a head defining a cavity for receiving a nut or bolt, a handle extending from the head, a mechanism for releasably retaining the nut or bolt in the cavity, said mechanism including a detent received in the head of the wrench for movement between a locking position wherein the detent is projected into the cavity and a release position where the detent is withdrawn into the wrench head, and an actuating mechanism for moving the detent between said positions, wherein the actuating mechanism includes a lever pivotally mounted on the exterior of the wrench head and extending down along the handle of the wrench, spring means interposed between the handle and the lever, the spring means urging the lever outwardly to a position wherein the detent is withdrawn from the wrench cavity into said opening, and a keeper pivotally mounted on the handle adjacent the lever and engaging the lever, wherein the lever has contiguous angularly related ramp surfaces along which the keeper can be moved without disengaging the lever, the keeper when engaging a first of the ramp surfaces allowing the lever to be urged outwardly by the spring means to the position wherein the detent is withdrawn from the wrench cavity, and the keeper when moved along the first ramp surface and into engagement with the second ramp surface camming the lever inwardly against pressure exerted by the spring means so as to move the detent into the locking position in the wrench cavity.

2. The invention of claim 1 wherein the keeper comprises a yoke-like member.

3. The invention of claim 1 wherein the lever is pivotally connected to the head of the wrench at its one end, and the ramp surfaces are formed at its other end.

4. A wrench comprising a wrench head defining a cavity for receiving a nut or bolt, a handle extending from the wrench head, an opening formed through the wrench head, a detent received in said opening, a lever pivotally mounted on an exterior surface of the wrench for movement inwardly and outwardly with respect to the wrench, the lever being connected with the detent for projecting the detent into the cavity so as to retain a bolt or nut therein and for withdrawing the detent from the cavity so as to release the bolt or nut responsive to said inward and outward movements of the lever, biasing means between the exterior of the wrench and the lever urging the lever outwardly of the wrench, and a thumb-operated keeper pivotally mounted on the handle of the wrench adjacent the lever and engaging the lever for holding the lever inwardly against the biasing means and releasing the lever for outward movement under the influence of the biasing means, wherein the lever has an outer surface formed with a pair of contiguous angularly related ramp surfaces along which the keeper can be moved without disengaging the lever, the keeper when engaging a first of the ramp surfaces allowing the lever to be urged outwardly by the biasing means to the position wherein the detent is withdrawn from the wrench cavity, and the keeper when moved along the first ramp surface and into engagement with the second ramp surface camming the lever inwardly against pressure exerted by the spring means so as to move the detent into the locking position in the wrench cavity.

* * * * *